United States Patent [19]

Yates

[11] Patent Number: 4,818,216

[45] Date of Patent: Apr. 4, 1989

[54] METHOD AND APPARATUS FOR REMOVING FUEL GUN FROM BOILER

[76] Inventor: Phillip J. Yates, 621 SW. Addie St., Port St. Lucie, Fla. 34983

[21] Appl. No.: 209,181

[22] Filed: Jun. 20, 1988

[51] Int. Cl.[4] ..... F23D 11/36

[52] U.S. Cl. ..... 431/154; 431/159; 432/76

[58] Field of Search ..... 432/3, 76; 431/154, 431/155, 189, 159, 356; 110/182.5, 349

[56] References Cited

U.S. PATENT DOCUMENTS 3,484,212 12/1969 Venable, Jr. et al. ..... 431/154 X 4,116,617 9/1978 Barkman et al. ..... 431/155 X 4,212,253 7/1980 Voituriez et al. ..... 110/182.5

*Primary Examiner*—Edward G. Favors

*Attorney, Agent, or Firm*—Alvin S. Blum

[57] ABSTRACT

Apparatus and method for withdrawing a tightly fitting fuel gun from the tubular gun port of a boiler employs a spreader with movable jaws inserted between the gun port and an enlarged external portion of the gun. One jaw of the spreader engages the outer edge of the tubular gun port. This jaw has an arcuate upper edge corresponding to the inner wall of the gun port. Position means permits accurate registry of the upper edge. Spreading the jaws forces the gun out. The arcuate upper edge of the jaw permits unobstructed passage of the gun past the jaw.

11 Claims, 7 Drawing Sheets

METHOD AND APPARATUS FOR REMOVING FUEL GUN FROM BOILER

BACKGROUND OF THE INVENTION

This invention relates to method and apparatus for withdrawing a tightly fitting cylindrical element from within a tubular support and more particularly to method and apparatus for removing a fuel gun from its tubular support on a boiler.

Stream boilers of power plants that are fired by fuel oil or gas employ a plurality of fuel guns through which fuel is forced into the fire box in a form optimized for combustion. The portion of the fuel gun that extends into the boiler has a cylindrical outer covering that engages a sleeve-like port welded to the boiler. When a fuel gun is shut off, it must be withdrawn from the gun port within an interval of several minutes if the gun is to be undamaged by the heat. The guns fit snugly within the gun ports, and they are often difficult to remove after having been in use, the high temperature operation causing them to be "frozen" in place. Various types of wedges, pry bars and hammers have been used for removal, but the process is awkward, slow and dangerous to equipment and maintenance personnel. The very narrow confines restrict access.

SUMMARY OF THE INVENTION

It is accordingly an object of the invention to provide a method and apparatus for forcefully withdrawing a fuel gun from a tubular gun port on a boiler that is faster, easier, and less injurious to the structures and personnel than current methods and apparatus.

The apparatus of the invention comprises a power spreader, including a pair of movable jaws pivotally joined at a first end and provided with means for spreading apart at a second end with a great deal of force using hydraulic, pneumatic or mechanical means for spreading apart. Hydraulic, pneumatic and mechanical spreaders are well known in the art. However, the narrow confines and particular structure of the fuel gun and gun port prevent the effective use of spreaders of the prior art in this application for forcing the fuel gun from the gun port. The gun port is a cylindrical steel sleeve welded to the steel face of the boiler. The portion of the fuel gun operationally within the boiler and the gun port has a tubular steel outer covering smaller than the inside diameter of the gun port. An annular flange surrounds the tubular steel covering and carries an O-ring for sealably engaging the inside diameter of the gun port. Outside the gun port, the fuel gun terminates in a heavy block with a portion extending below the level of the gun port with connectors for circulating fuel oil. The continuous oil circulation provides a feed of fuel for burning and also cools the gun. When oil circulation is cut off for removal of the gun, the gun must be promptly removed from the fire box to prevent damage.

Spreaders of the prior art can fit between the depending end portion of the fuel gun and the outer edge of the gun port. However, the jaws of the spreaders of the prior art have straight upper edges that prevent the flange from moving out of the gun port, so they cannot be used. The spreader of the invention has a first jaw with straight edges for engaging the external dependent portion of the gun and a second jaw with an arcuate depressed portion of the upper edge configured to engage the outer edge of the gun port and freely pass the flange on the fuel gun as it emerges from the gun port.

An indexing or positioning means on the outer face of the second jaw ensures correct positioning of the spreader relative to the edge of the gun port within the confined space.

The method of removing the fuel gun from the gun port comprises: inserting the spreader into the space between the dependent portion of the gun and the outer edge of the gun port; using the positioning means to position the arcuate upper edge of the jaw along the outer edge of the gun port; and applying the spreading force (preferrably hydraulic) to the spreader to spread the two jaws apart. The fuel gun is thereby forced out of the gun port to a point wherein the flange is outside the gun port. At this point, the gun is freely movable with the gun port and it may be pulled out manually by its handle.

DETAILED DESCRIPTION OF PREFERRED EMBODIMENT

Figure 1:
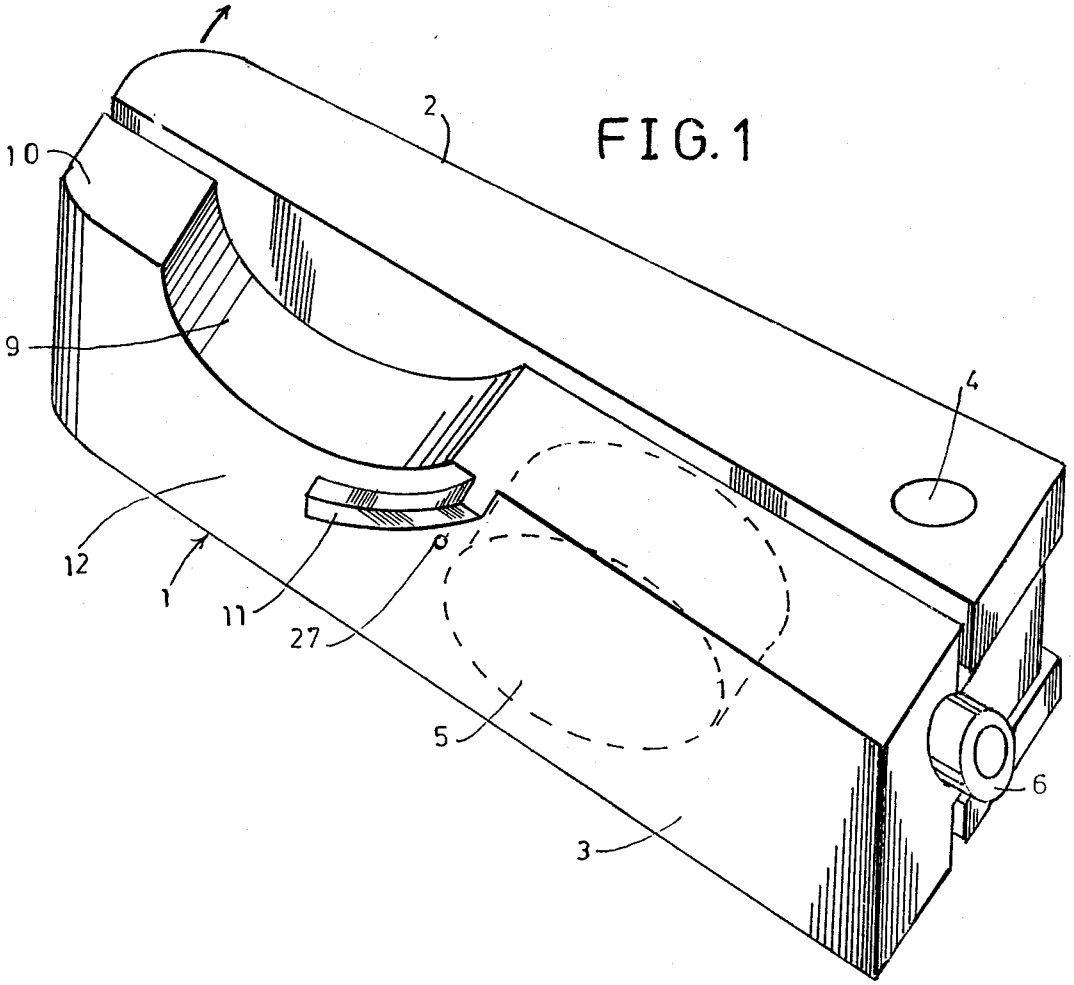
FIG. 1 is a perspective view of the spreader of the invention.

Referring now first to FIG. 1, a spreader 1 of the invention comprises a first jaw 2 and a second jaw 3 hingeably joined by pivot pin 4. Inside a hollowed-out portion of second jaw 3 is mounted a hydraulic cylinder 5 connected to hydraulic coupling 6. A hydraulic hose and pump (not shown) of the type well known in the art are connected to coupling 6 for spreading apart of the jaws with great force. Hydraulic fluid pressure within cylinder 5 forces a hydraulic piston against jaw 2 causing it to move away from jaw 3. The spreading forces generated by spreaders of this type are considerably greater than required to force the fuel gun out of its port. Apparatus of this type and size are exemplified by Spread Cylinder Model #WR-4 and hydraulic hand pump model P-141 by Applied Power Inc. The combination applies a spreading force of 1500 pounds with just a few strokes of the pump. In spreader cylinders of the prior art both jaws have straight edges as in jaw 2 of FIG. 1.

Figure 2:
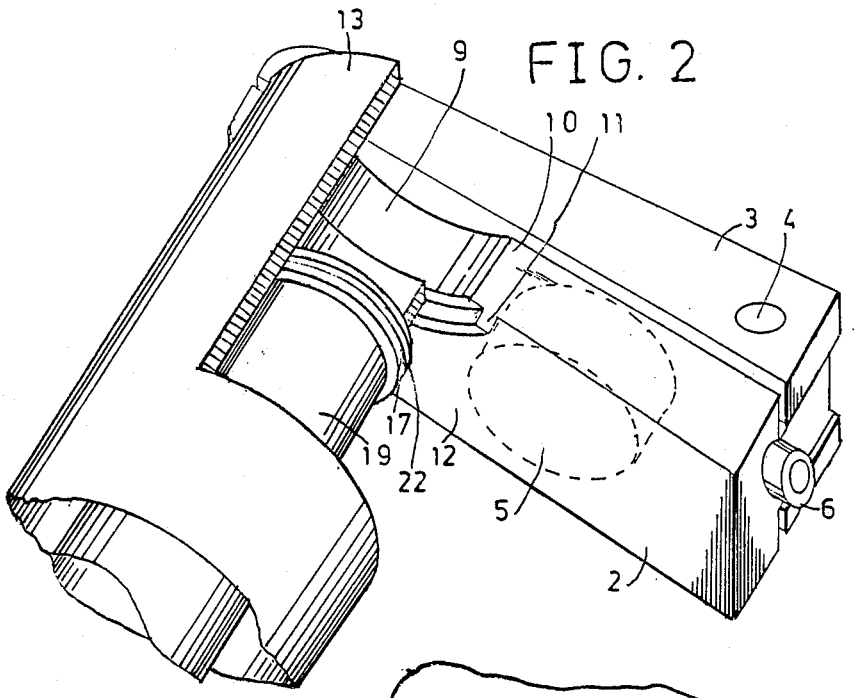
FIG. 2 is a perspective view of the spreader of FIG. 1 in position on the gun port with portions of the fuel gun and gun port broken away.
Figure 6:
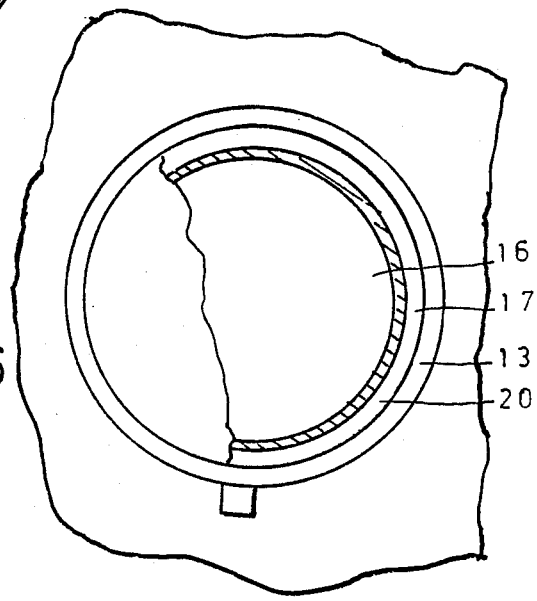
FIG. 6 is a front elevation view of the gun port with the fuel gun and flange in place.
Figure 3:
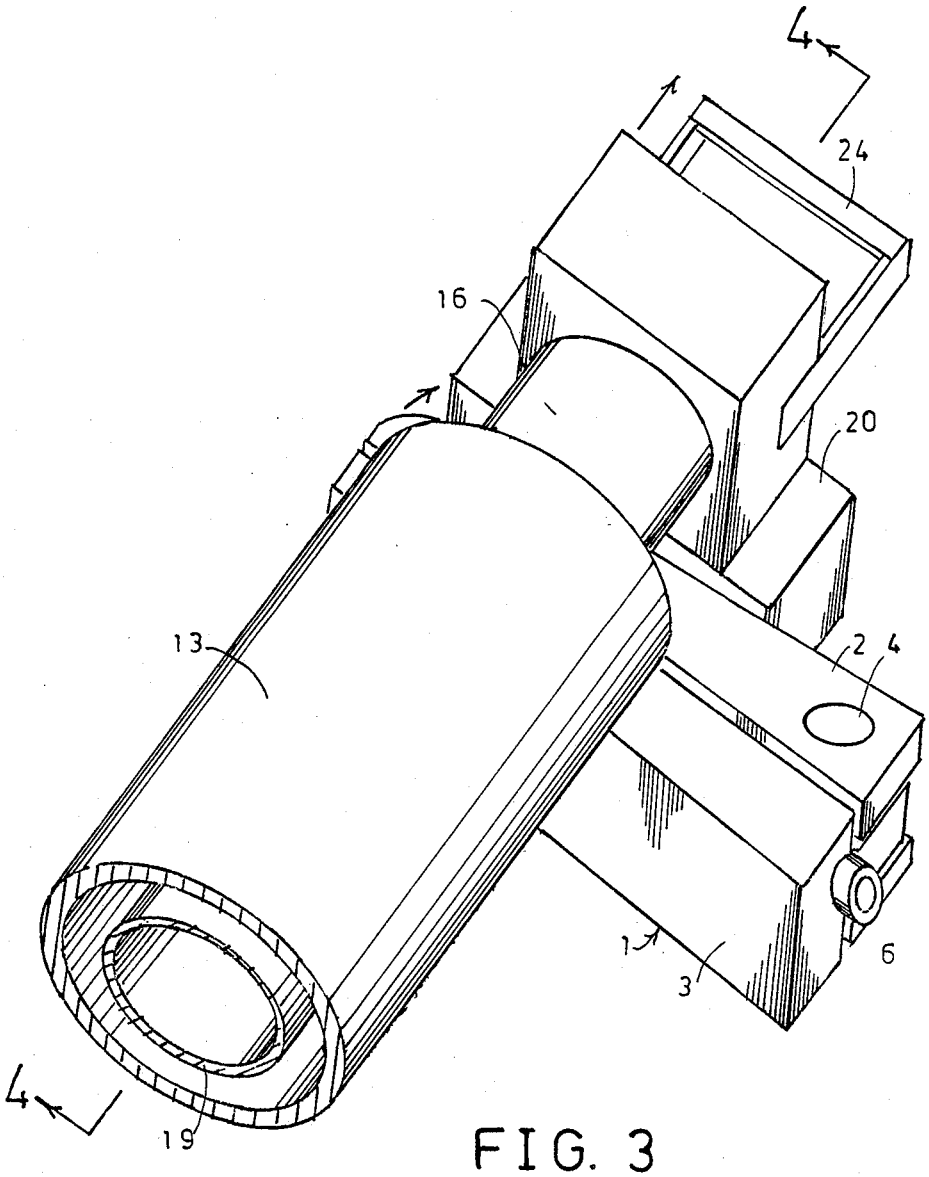
FIG. 3 is a perspective view of the spreader of FIG. 1 in position on the gun port.
Figure 4:
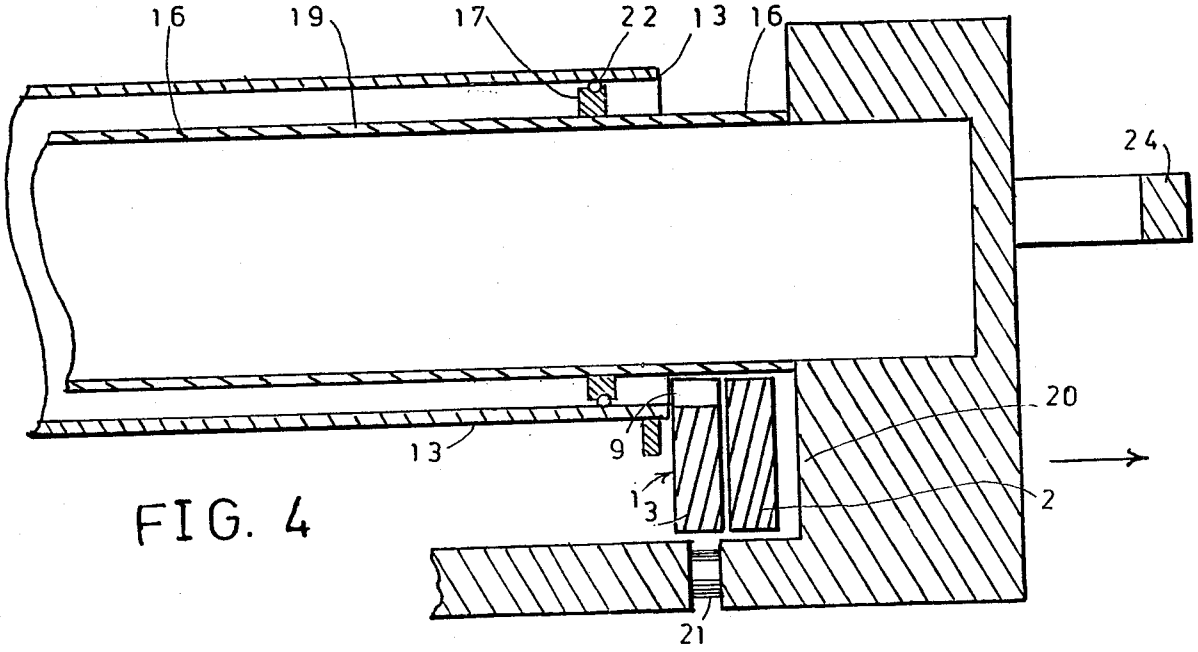
FIG. 4 is a cross sectional view taken through 4—4 of FIG. 3.
Figure 7:
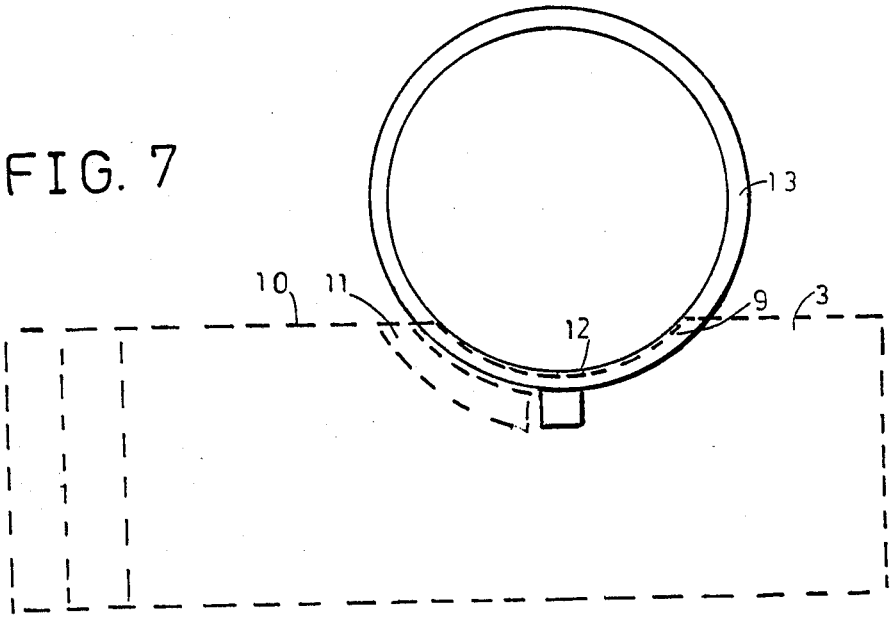
FIG. 7 is a front elevation view of the gun port with the spreader in place.
Figure 5:
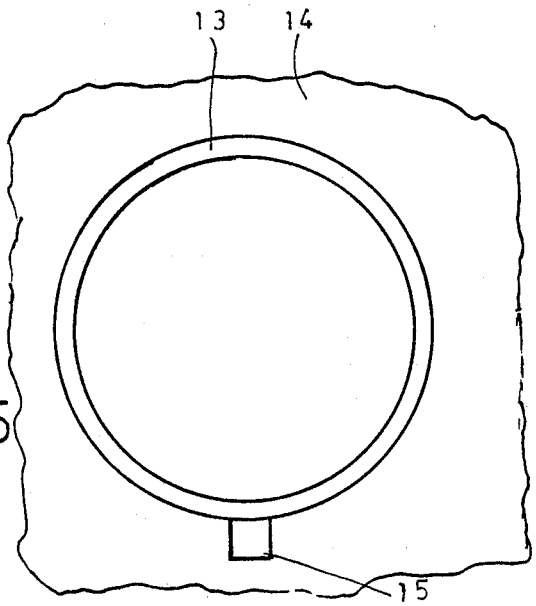
FIG. 5 is a front elevation view of the gun port.
Figure 8:
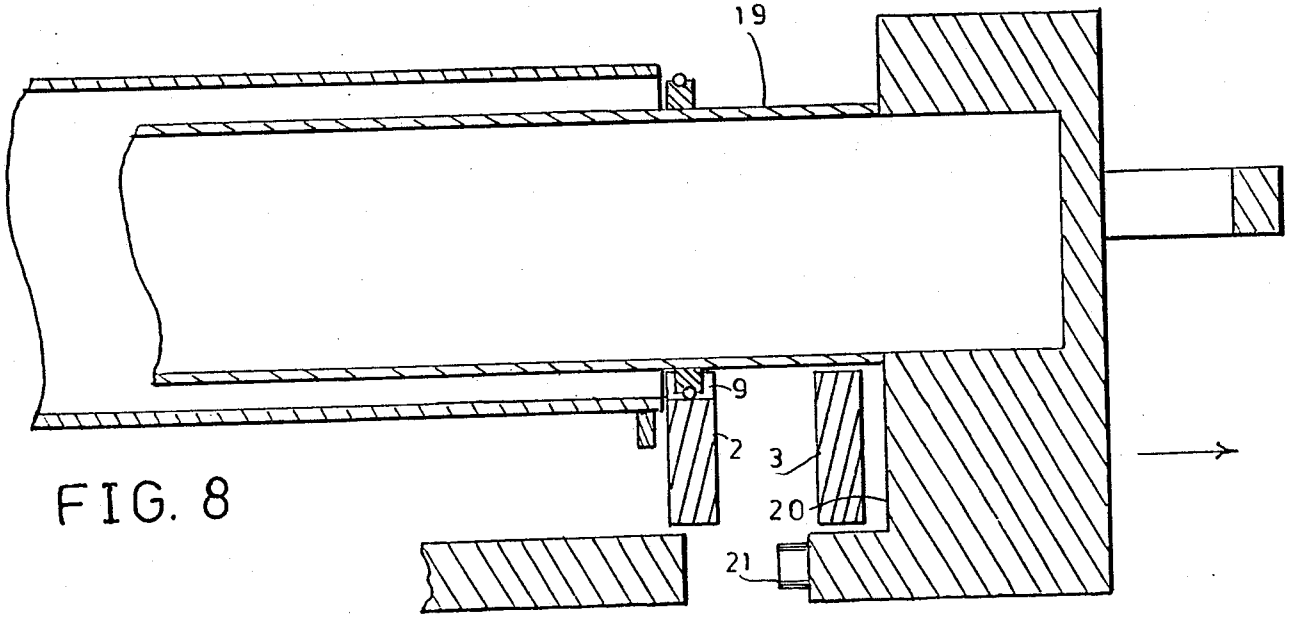
FIG. 8 is a cross sectional view as in FIG. 4 after the spreader has been actuated and the fuel gun forced out past its flange.

However the spreader of the invention differs from the prior art in the structure of jaw 3, wherein an arcuate depression 9 is formed in the upper edge 10. A positioning means 11 is attached to the outer face 12 of jaw 3. FIG. 5 is a view of the tubular gun port 13 welded to the front face 14 of the boiler. A nut 15 may be attached to the port for securing a cover when the gun is removed. FIG. 6 shows the fuel gun 16 in place in the gun port 13 with annular flange 17 welded to the outer cylindrical cover 20 of the fuel gun. The inner components of the fuel gun such as fuel lines and spray nozzles are not shown. FIG. 7 shows another view of the gun port 13 with jaw 3 of the spreader in operating position. As shown the radius of curvature of the arcuate depression 9 in the upper edge 10 of jaw 3 corresponds substantially to the inner diameter of gun port 13 and the radius of curvature of the smaller radius of positioning means 11 corresponds substantially to the outer diameter of gun port 13. When the positioning means 11 is fitted against the outer surface of the gun port 13 and the outer face 12 of the jaw is fitted against the outer face of the gun port as shown in FIGS. 2, 3 and 7, a clear pathway is left for the passage of the fuel gun flange 17 through the gun port 13 and past jaw 3. FIG. 4 shows the device 1 in position between the outer edge of the port 13 and the exterior portion 20 of the gun 16 that extends below the level of the gun port 13. This portion contains fuel connectors 21 that circulate fuel oil to the gun for cooling and feeding. The flange 17 is welded to the tubular steel portion 19 of the gun and an O-ring 22 seals the gun 16 tightly in the port 13. When hydraulic fluid pressure is applied to the spreader 1 through coupling 6, the gun moves outwardly in the direction of arrow 23 a jaw 2 is forced away from jaw 3 in the direction of arrow 7. As best seen in FIG. 8, when jaw 2 has been forced away from jaw 3, the jaw 2 impinging on depending portion 20 forces gun 16 out of gun port 13 until flange 17 has passed beyond the edge of the gun port. The portion of the gun 16 remaining within the port fits very loosely and the gun can now be pulled out with the handle 24.

Figure 9:
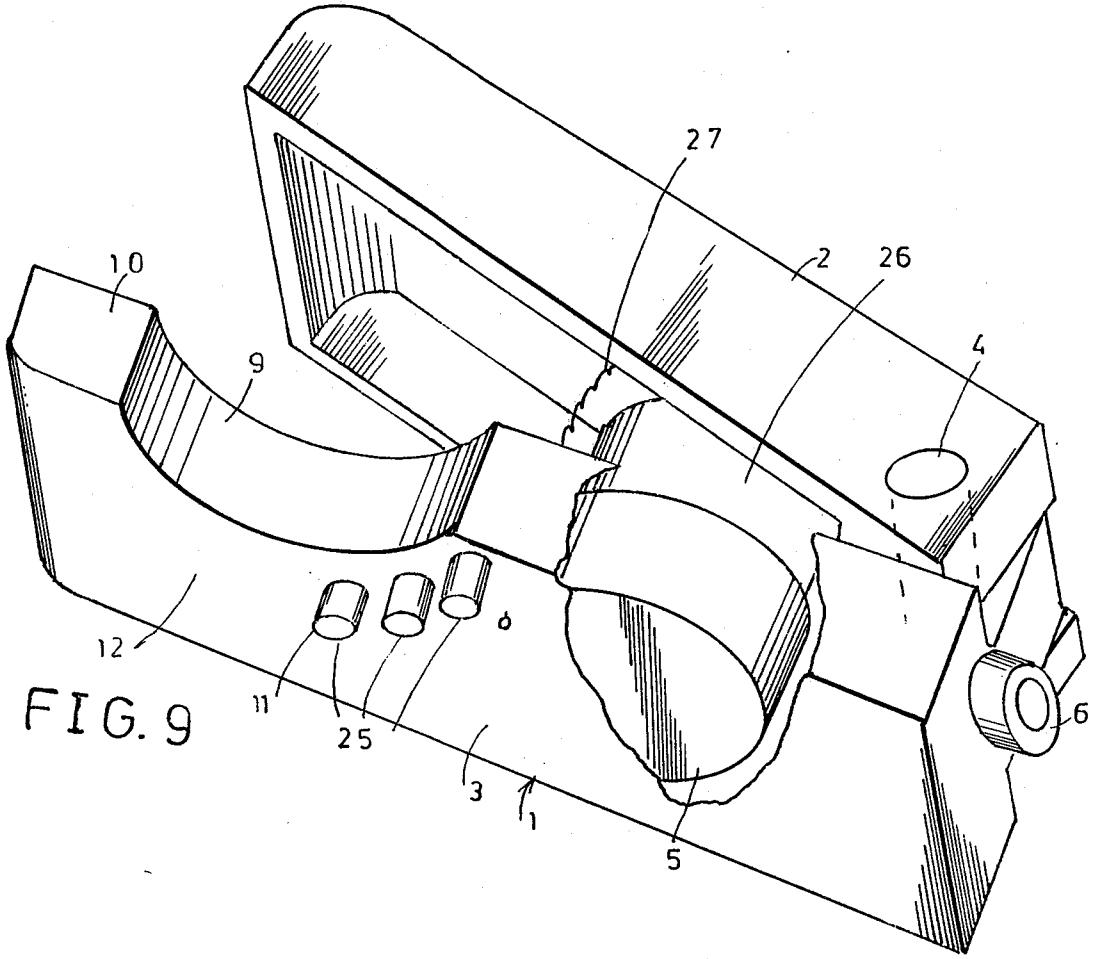
FIG. 9 is a perspective view of another embodiment of the spreader of the invention.

In the alternative embodiment of the invention illustrated in FIG. 9 the positioning means 11 comprised a row of pegs 25 arranged in an arc on the outer face 12 of jaw 3. A portion of jaw 3 is broken away to show the hydraulic cylinder 5, the hydraulic piston 26 that extends from the cylinder 5 and forces jaw 2 away from jaw 3. The extension spring 27 pulls the jaws together when hydraulic pressure is released.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. Apparatus for withdrawing from a tubular fuel gun port a tightly-fitting fuel gun having an enlarged external portion, said apparatus comprising:

(a) a first jaw means for engaging said enlarged portion of said fuel gun;

(b) a second jaw means for engaging the outer edge of said gun port;

(c) connecting means for pivotally connecting said first jaw means to said second jaw means at a first end of each said jaw means;

(d) spreading means interposed between said first jaw means and said second jaw means for forcefully spreading apart said jaw means, whereby a second end of each said jaw means is spread apart one from the other while said first ends pivot about said connecting means;

(e) said second jaw means including an edge between said first end and said second end, said edge having a curvilinear portion substantially corresponding to the inner curvature of said gun port to provide clearance for unobstructed passage of said fuel gun during withdrawal;

(f) said second jaw means further including positioning means for positioning said curvilinear portion against the outer edge of said gun port and in registry therewith to provide said clearance for unobstructed passage of said fuel gun;

(g) wherein said spreading means forces said first jaw means against said expanded portion of said gun and said second jaw means against the outer edge of said gun port, thereby forcing said gun out of said gun port.

2. The apparatus according to claim 1 in which said spreading means is a hydraulic cylinder.

3. The apparatus according to claim 1 in which said spreading means is a pneumatic cylinder.

4. The apparatus according to claim 1 in which said positioning means includes arcuate ridge means having a surface corresponding to the outer surface of said gun port.

5. The apparatus according to claim 1 in which said positioning means includes a plurality of projections.

6. A method for withdrawing from a tubular fuel gun port a tightly-fitting fuel gun having an enlarged external portion, the method comprising the steps of:

(A) inserting a spreader having a first jaw and a second jaw between said external portion of said gun and said gun port;

(B) positioning the first jaw of said spreader against the outer edge of said gun port with positioning means so that the upper edge of said first jaw is in registry with the inner wall of said gun port;

(C) forcing said jaw of said spreader away from said first jaw by spreading means to force said jaw against said external portion of said gun to thereby force said gun out of said gun port far enough to permit subsequent manual removal.

7. Apparatus for withdrawing from a tubular fuel gun port a tightly-fitting fuel gun having an enlarged external portion, said apparatus comprising:

(a) a first jaw means for engaging said enlarged portion of said fuel gun;

(b) a second jaw means for engaging the outer edge of said gun port;

(c) connecting means for movably connecting said first jaw means to said second jaw means;

(d) spreading means interposed between said first jaw means and said second jaw means for forcefully spreading apart said jaw means;

(e) said jaw means including an edge between a first end and a second end, said edge having a curvilinear portion substantially corresponding to the inner curvature of said gun port to provide clearance for unobstructed passage of said fuel gun during withdrawal;

(f) said second jaw means further including positioning means for positioning said curvilinear portion against the outer edge of said gun port and in registry therewith to provide said clearance for unobstructed passage of said fuel gun;

(g) wherein said spreading means forces said first jaw means against said expanded portion of said gun and said second jaw means against the outer edge of said gun port, thereby forcing said gun out of said gun port.

8. The apparatus according to claim 7 in which said spreading means is a hydraulic cylinder.

9. The apparatus according to claim 7 in which said spreading means is a pneumatic cylinder.

10. The apparatus according to claim 7 in which said positioning means includes arcuate ridge means having a surface corresponding to the outer surface of said gun port.

11. The apparatus according to claim 7 in which said positioning means includes a plurality of projections.

* * * * *